US005289357A

United States Patent [19]

Fabbri

[11] Patent Number: 5,289,357

[45] Date of Patent: Feb. 22, 1994

[54] TASK-ORIENTED LIGHT FIXTURE FOR A WORKSPACE

[75] Inventor: William C. Fabbri, Billerica, Mass.

[73] Assignee: The Genlyte Group Incorporated, Secaucus, N.J.

[21] Appl. No.: 18,076

[22] Filed: Feb. 16, 1993

[51] Int. Cl.[5] ..... F21S 3/00

[52] U.S. Cl. ..... 362/223; 362/225; 362/33

[58] Field of Search ..... 362/33, 97, 223, 225

[56] References Cited

U.S. PATENT DOCUMENTS 4,161,767 7/1979 Benasutti et al. ..... 362/225

*Primary Examiner*—Carroll B. Dority

*Attorney, Agent, or Firm*—Kane, Dalsimer, Sullivan, Kurucz, Levy, Eisle and Richard

[57] ABSTRACT

The apparatus is a light fixture with end reflectors inwardly adjacent to and at an acute angle to the shorter ends thereof. A U-shaped fluorescent bulb is inwardly adjacent to the end reflectors and at a similar acute angle to the shorter ends of the light fixture. Front reflectors rise at a gentle angle at points inwardly adjacent from the bulbs and meet at an apex therebetween. An upper reflector is inwardly adjacent from the top of the fixture.

18 Claims, 3 Drawing Sheets

FOOTCANDLE READINGS

ROOM TEMP. 25°

A - 120 VOLTS/31 WATTS
B - 120 VOLTS/31 WATTS
C - 120 VOLTS/31 WATTS

TASK-ORIENTED LIGHT FIXTURE FOR A WORKSPACE

BACKGROUND OF THE INVENTION

1. Field of the Invention

The invention pertains to a light fixture for a workspace wherein the light fixture is task-oriented and, by way of an angled U-shaped fluorescent bulb, achieves a desirable light distribution on the workspace.

2. Description of the Prior Art

In the prior art, it is well-known that a task-oriented light fixture for a workspace requires a specialized light distribution pattern which is not found in typical ambient lighting. That is, a task-oriented light fixture for a workspace requires light to be concentrated within a particular space. This is usually accomplished, in part, by placing the light fixture close to the workspace in conjunction with high intensity bulbs and focusing lenses. However, such close proximity of the light fixture to the workspace can create harsh shadows and glare which can cause eye strain and fatigue in the worker.

OBJECTS AND SUMMARY OF THE INVENTION

It is therefore an object of this invention to provide a task-oriented light fixture for a workspace.

It is therefore a further object of this invention to provide such a light fixture which creates a desirable light distribution pattern for high detail work.

It is therefore a still further object of this invention to provide such a light fixture which produces a minimum of harsh shadows and glare, particularly when producing a high intensity light distribution pattern on the workspace.

It is therefore a final object of this invention to provide a light fixture with a minimum of expensive high-tolerance reflectors and lenses.

These and other objects are achieved by providing a light fixture wherein two U-shaped bulbs, each at an opposing end of the fixture and symmetric with each other, are at an acute angle to the ends of the light fixture. The light fixture also includes first reflectors outwardly adjacent to the angled bulbs and second reflectors inwardly adjacent to the angled bulbs. The light fixture directs light from each bulb generally inward to an area approximately twenty-four inches under the center of the fixture. The light fixture is installed so that this area corresponds to the desired workspace.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
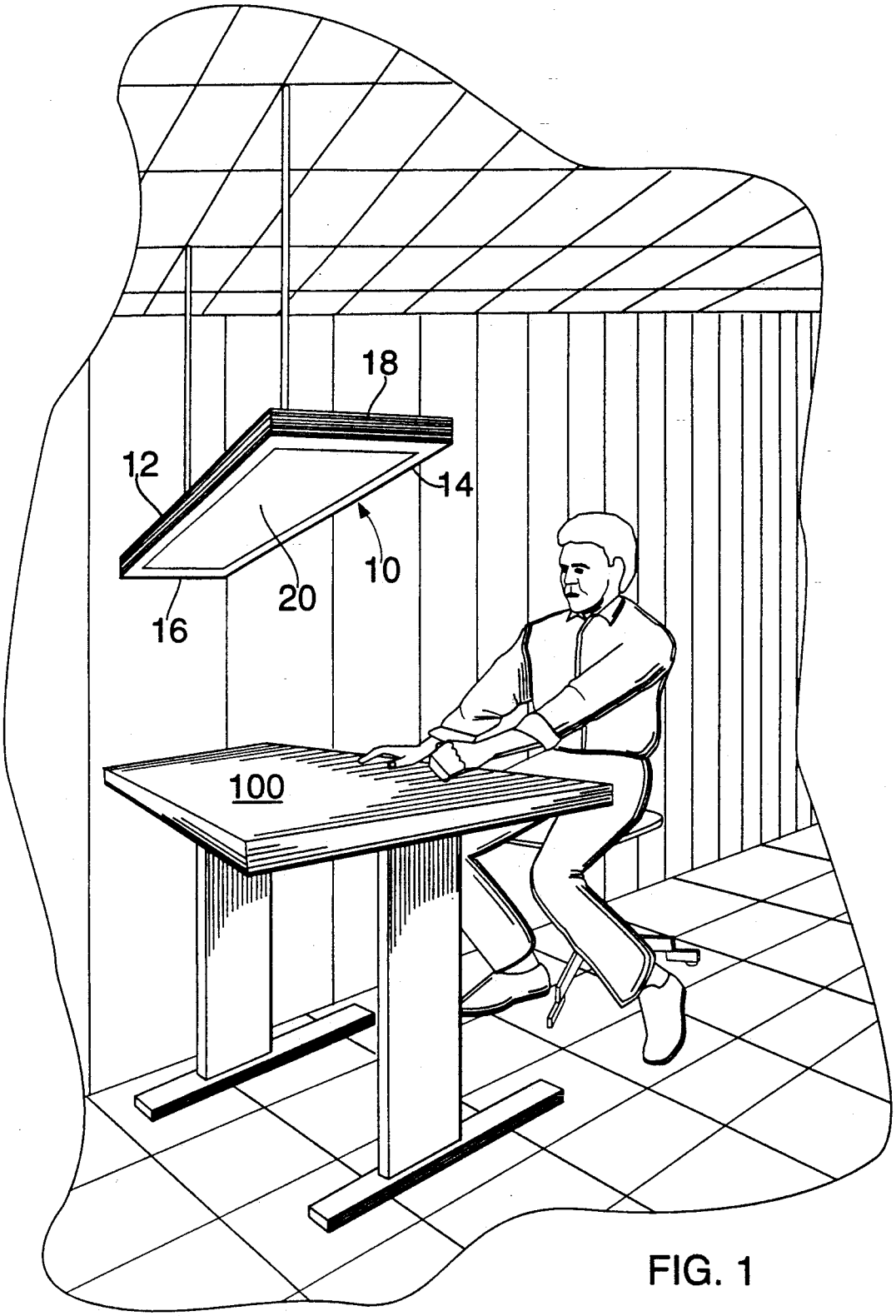
FIG. 1 is a perspective view of the light fixture of the present invention, as viewed in its environment of the workspace.

Referring now to the drawings in detail wherein like numerals refer to like elements throughout the several views, one sees that FIG. 1 shows light fixture 10 within its working environment. Light fixture 10 has long sides 12, 14 of approximately forty-eight inches perpendicular to short sides 16, 18 of approximately nine inches. Light fixture 10 is therefore of a standard shape. Light fixture 10 is of a depth of approximately 2.312 inches. Light fixture 10 typically mounted about 24 inches (this can vary) above a workspace 100 with lens 20, preferably of extruded acrylic, through which light passes, oriented directly downward. For purposes of clarity, FIG. 1 shows light fixture 10 suspended from a ceiling over the workspace 100. However, light fixture 10 is at least as likely to be secured to the walls of a cubicle-type workspace.

Figure 2:
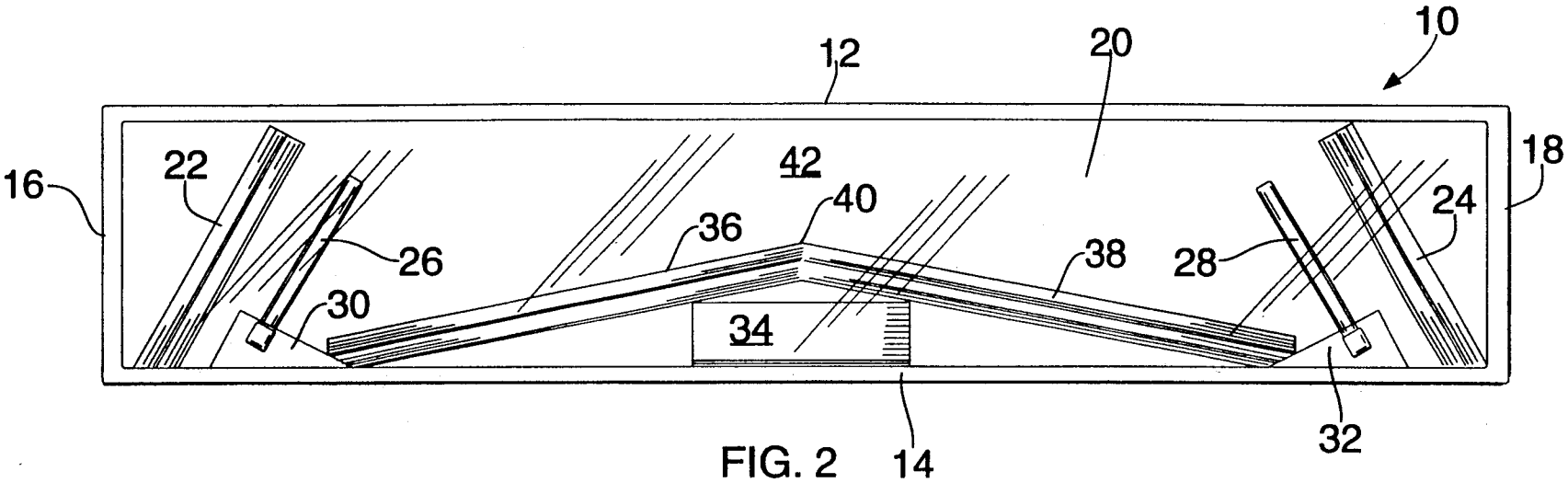
FIG. 2 is a plan view, partly in cross section, of the light fixture of the present invention, as viewed from below the light fixture.

FIG. 2 is a plan view of light fixture 10 looking upward through lens 20. For purposes of illustration, lens 20 is shown herein as clear. However, lens 20 preferably includes at least some translucent, prismatic or diffusing characteristics.

End reflectors 22, 24 are immediately inwardly adjacent from short sides 16, 18, respectively. End reflectors 22, 24 are preferably made of specular aluminum. End reflectors 22, 24 are oriented at approximately 30° from short sides 16, 18, respectively and 60° from long side 14 (other intermediate acute angles, i.e., substantially different from the extremes of 0° or 90°, may be used for some applications). End reflectors 22, 24 are slightly angled to the surface of lens 20.

Bulbs 26, 28 are inwardly adjacent from and parallel to end reflectors 22, 24. As can be seen more clearly from FIG. 3, bulbs 26, 28 are U-shaped fluorescent bulbs, preferably 4¼ inch, thirteen-watt "Biax" ® bulbs. Bulbs 26, 28 are engaged by sockets 30, 32 secured to long side 14 so as to orient bulbs 26, 28 at approximately 30° from short sides 16, 18, respectively, and 60° from long side 14. Sockets 30, 32 are in electrical communication with ballast 34, which is positioned at the midpoint of long side 14. Ballast 34 is, in turn, in electrical communication with an external electrical source (not shown) via an electrical on/off switch (not shown).

Front reflectors 36, 38 start at a point immediately inwardly adjacent from sockets 30, 32 on long side 14, rise at a gentle acute angle (substantially 11°-12°) from long side 14, and meet at apex 40 immediately over ballast 34. This formation of front reflectors 36, 38 separates ballast 34 from light chamber 42. Front reflectors 36, 38 are preferably coated with baked white enamel for high reflectivity and dispersal.

Figure 3:
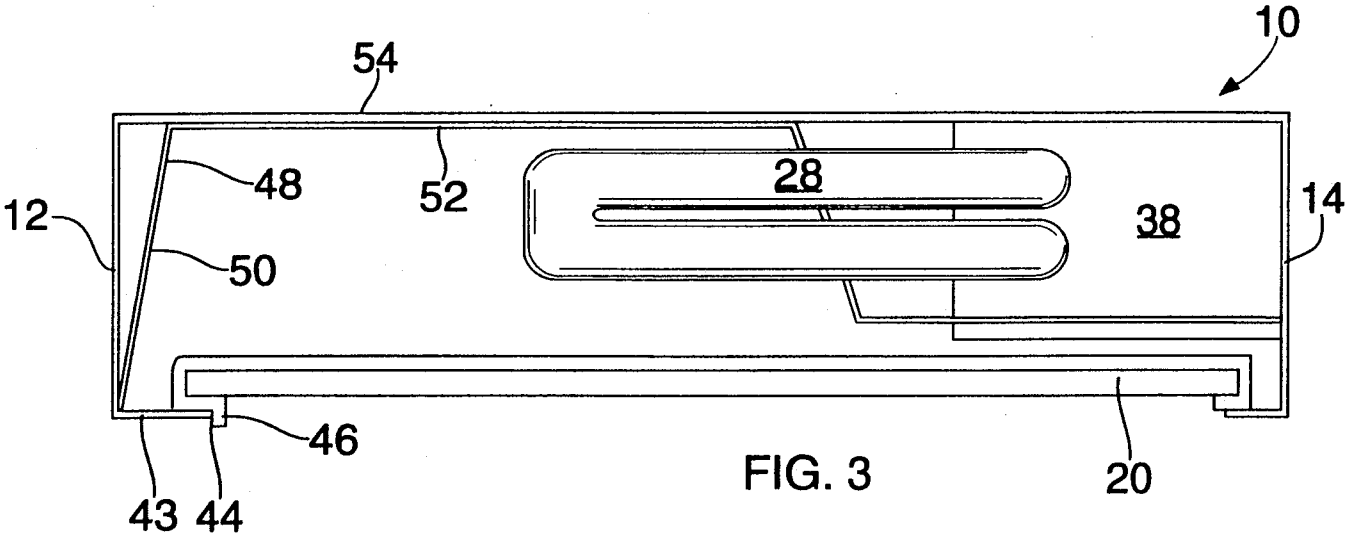
FIG. 3 is a plan view of the end of the light fixture of the present invention.

As can be seen from FIG. 3, light fixture 10 includes lower wall 43 which includes aperture 44 thereby forming lip 46 which engages lens 20 (as stated previously, lens 20 is preferably of extruded acrylic). Light fixture further includes internal reflector 48, preferably of baked white enamel, which includes wall 50 which is slightly inclined from long side 12, and wall 52 which is inwardly flush with top surface 54 of light fixture 10. While the legs of bulb 28 are illustrated as one immediately above the other, bulb 28 can be rotated from the vertical (i.e., about the horizontal longitudinal axis) by 10°.

Figure 4:
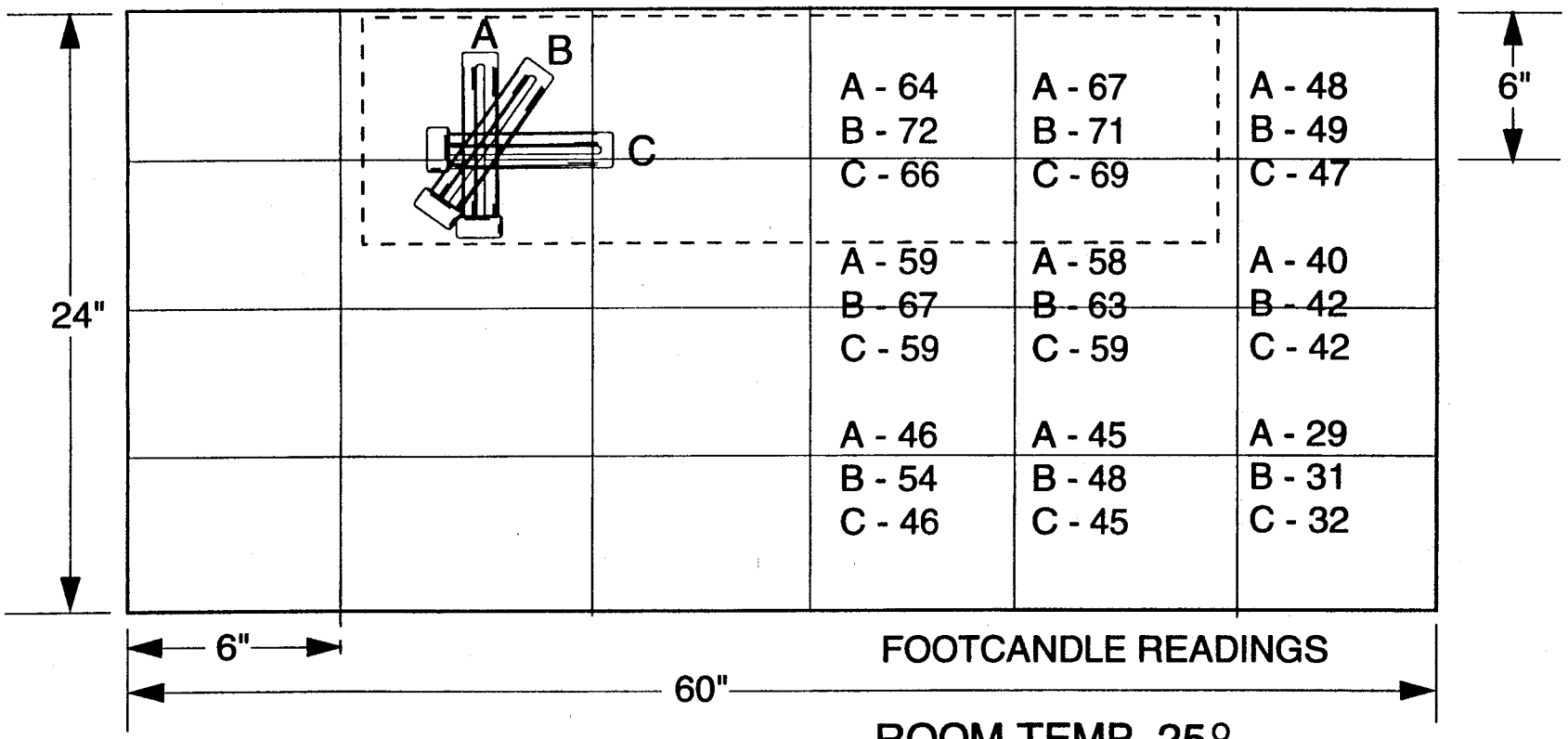
FIG. 4 illustrates a light distribution pattern of the light fixture of the present invention.

Light is reflected from bulbs 26, 28 by reflectors 22, 24, 36, 38, and 48, and then downwardly through lens 20. FIG. 4 illustrates the superior illumination distribution which is achieved by the angle of orientation of bulbs 26, 28 when light fixture 10 is positioned with regard to workspace 100 substantially as illustrated in perspective in FIG. 1. One can see that a brighter central illumination is achieved by the angled orientation of bulb position B, similar to the orientation shown in FIG. 2.

To use light fixture 10, the user installs light fixture 10 as configured in FIG. 1, and orients the bulbs as shown in FIG. 2. The user then turns on light fixture 10 by use of an on/off switch (not shown), thereby achieving a light distribution pattern similar to that corresponding to position B in FIG. 4.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. A light fixture including:

first and second long sides perpendicular to first and second short sides;

a top;

a bottom;

a downwardly oriented aperture formed in said bottom;

first and second end reflectors inwardly adjacent to said first and second short sides, respectively, and oriented at a first acute angle thereto;

first and second fluorescent sockets, including respective first and second fluorescent bulbs, inwardly adjacent from said first and second end reflectors, respectively, wherein said first and second end reflectors are oriented at a second acute angle with respect to said first and second short sides; and first and second front reflector portions inwardly adjacent from said first and second fluorescent sockets, respectively, said first and second front reflector portions rising at a third acute angle from one of said first and second long sides.

2. The light fixture of claim 1 wherein said first and second acute angles are substantially equal to each other, are substantially different from zero degrees, and are substantially different from ninety degrees.

3. The light fixture of claim 2 wherein said first and second acute angles are substantially equal to thirty degrees.

4. The light fixture of claim 3 wherein said third acute angle is substantially equal to eleven degrees.

5. The light fixture of claim 4 wherein said first and second front reflectors meet in an apex thereby forming a chamber therebetween.

6. The light fixture of claim 5 wherein said chamber includes a ballast means in electrical communication with said first and second fluorescent sockets.

7. The light fixture of claim 3 further including an upper reflector means inwardly adjacent from said top.

8. The light fixture of claim 7 wherein said first and second end reflectors are specular aluminum or other specular material.

9. The light fixture of claim 8 wherein said first and second front reflectors and said upper reflector means include a white enamel coating.

10. The light fixture of claim 3 wherein said long sides are approximately forty-eight inches long.

11. The light fixture of claim 10 wherein said short sides are approximately nine inches long.

12. The light fixture of claim 3 wherein light is directed downwardly through said aperture and concentrated at a point substantially twenty-four inches below and twelve inches towards the front of the light fixture.

13. The light fixture of claim 12 wherein a lens is engaged within said downwardly oriented aperture.

14. The light fixture of claim 13 wherein said lens is prismatic.

15. The light fixture of claim 13 wherein said lens is made from extruded plastic.

16. The light fixture of claim 3 wherein said fluorescent bulbs are U-shaped bulbs.

17. The light fixture of claim 16 wherein said fluorescent bulbs are "biax" bulbs.

18. The light fixture of claim 16 wherein said fluorescent bulbs are rotated from the vertical position by 10°.

* * * * *